United States Patent [19]

Stott

[11] Patent Number: 4,825,913

[45] Date of Patent: May 2, 1989

[54] POWDER DISPENSING APPARATUS

[76] Inventor: Leslie Stott, c/o L. E. Stott Ltd., Vale St., Beech Industrial Estate, Bacup, Lancashire, United Kingdom, OL13 9EQ

[21] Appl. No.: 85,345

[22] Filed: Aug. 14, 1987

[30] Foreign Application Priority Data

Aug. 28, 1986 [GB] United Kingdom ..... 8620839

[51] Int. Cl.[4] ..... B65B 1/28

[52] U.S. Cl. ..... 141/59; 141/93; 141/114; 141/65; 141/287

[58] Field of Search ..... 141/59, 65, 93, 114, 141/68, 67, 285, 287, 289, 290, 310

[56] References Cited

U.S. PATENT DOCUMENTS

| | | | |
|---|---|---|---|
| 644,855 | 3/1900 | Forster | 141/93 |
| 2,105,589 | 1/1938 | Eades | 141/93 |
| 2,524,560 | 10/1950 | Cote | 141/93 X |
| 2,908,299 | 10/1959 | Gosselin | 141/287 |
| 3,118,474 | 1/1964 | Eppolito | 141/68 |
| 3,867,969 | 2/1975 | Garnett | 141/59 |
| 3,881,894 | 5/1975 | Onufer | 141/93 X |
| 4,061,221 | 12/1977 | Higashinaka et al. | 141/93 X |
| 4,182,591 | 1/1980 | Stanelle | 141/93 X |
| 4,574,851 | 3/1986 | Lepisto | 141/287 X |

*Primary Examiner*—Ernest G. Cusick
*Attorney, Agent, or Firm*—Reising, Ethington, Barnard, Perry & Milton

[57] ABSTRACT

An apparatus for transferring powder from a bulk supply to a container comprising a first conduit extending from the bulk supply to the container, an inflatable annulus made preferably from natural rubber, secured towards the end of the conduit and adapted to enter into air-tight engagement with the wall of a container which can be a bag or sack having flexible walls or a drum or carton having rigid walls. The appartus is also provided with a second conduit having an opening in the container to allow air displaced by powder entering to escape. The second conduit communicates with an exhaust fan to assist the removal of displaced air. A third conduit is also provided having an opening within the container. This opening is placed in close proximity to the outlet situated within the container of the second conduit. When the exhaust fan operates a stream of air enters the container through the third conduit and passes first through the container causing minimum of disturbance to powder which has been delivered and then through the second conduit. This arrangement prevents powder accumulating in the second conduit. The apparatus preferably forms part of a weighing machine so that predetermined quantities of powder can be delivered accurately into the container.

9 Claims, 2 Drawing Sheets

POWDER DISPENSING APPARATUS

TECHNICAL FIELD

This invention relates to an apparatus for transferring powder from a bulk supply to containers of smaller size, for example boxes and bags etc.

BACKGROUND ART

The transfer of powders from a bulk supply to smaller containers for marketing or storage is complicated by the fact that the flow characteristics of powders are very different from those of liquids. For example some powders tend to be sticky and flow only with difficulty whilst others may be of a very light and flocculent nature so that when they are poured into a container air which is displaced carries with is substantial quantities of entrained powder. This can cause fire hazards if the powder is flammable or financial loss and danger to health if the powder is expensive or toxic.

The filling of a large number of containers with powder from a bulk supply must for practical reasons be carried out rapidly and under conditions so that preferably the escape of powder is prevented or if this is not possible then efficient methods of powder recovery are employed. Various measures have been employed for the purposes of achieving this objective. For example one of these involves fitting the delivery end of a conduit extending from the bulk supply of powder to be transferred to the container to be filled with an inflatable annulus which can be inflated and made to grip and form an air-tight seal with the mouth of the container. A second conduit is then provided between external wall of the inlet conduit and the inflatable annulus through which displaced air containing entrained powder can pass on its way to a powder recovery station where powder can be recovered. In order to assist the process a draught created by an exhaust fan assists the removal of displaced air. However in order to avoid any excessive reduction in pressure within the container air from outside the container is allowed to enter the container through a third conduit and merge with the effluent stream of air leaving the container.

In this way an improvement has been effected in transferring powder. However this technique results in excessive quantities of powder being carried from the container to the removal recovery plant. Furthermore the conduit from the container to the plant tends to have powder deposited in it. We have now discovered that both problems can be overcome to a significant extent if the inlet for the scavenging stream of air and the outlet for the displaced air are located close together within the container. In this way a sufficiently vigorous stream of air can be passed through the conduit to prevent deposition of powder within the conduit without a major disturbance of powder already in the container. As a consequence removal of large quantities of powder in the air stream can be prevented. This has the further advantage in that since apparati for filling containers from bulk supply are generally required to be programmed to deliver predetermined weights of material we have found that as a result of the present invention we are able to programme the apparati to deliver such quantities more accurately.

SUMMARY OF INVENTION AND ADVANTAGES

Accordingly this invention comprises an apparatus for transferring powder from a bulk supply to a container comprising a first conduit extending from the bulk supply to the container, an inflatable annulus made from resilient material arranged round the end of the conduit and adapted to enter into air-tight engagement with the wall of the container, a second conduit having an opening within the container for allowing the escape of air displaced from the container when powder is being discharged from the first conduit into the container the second conduit communicating with suction means to assist the removal of displaced air and a third conduit enabling a stream of air to be drawn by the suction means from outside the apparatus and to discharge from an orifice within the container the orifice being in close proximity to the outlet within the container of the second conduit.

For the purposes of this invention the term 'powder' is taken to include any solid material which is subdivided into particles and the term includes granules, pellets and the like.

The apparatus can be used for filling containers such as sacks made of plastics and paper having flexible walls or other forms of containers such as lined drums and cartons having rigid walls although the precise design of the apparatus will depend upon the nature of the container. For example for the filling of bags the apparatus should be provided preferably with an inflatable annulus which acts radially on the inner surface of the bag. However when drums are to be filled the annulus should be arranged preferably to act axially on the rim of the wall of the drum.

The efficiency of the apparatus depends frequently on the manner in which the powder flows from the bulk supply to the container and in general measures to control the entry of the powder into the container are required. The nature of these will depend upon the physical characteristics of the powder to be handled. For example in the case of a powder which does not flow easily the apparatus is fitted preferably with a vibrating valve so as to ensure that the powder is maintained in a sufficiently fluid condition to enable it to flow. Other forms of transference include the use of an Archimedean or other form of screw conveyor.

The present apparatus is of special use when it forms part of a weighing machine. This can if desired be linked with a programming device which controls the supply of powder from a bulk supply to the container and interrupts the supply when a predetermined quantity has been delivered. However the programming device can be omitted in which case the supply of powder will require to be discontinued manually when the required quantity has been delivered into the container.

FIGURES IN THE DRAWINGS

This invention is illustrated but not restricted by the following drawings which are both side views taken in vertical section of two preferred forms of invention apparatus.

DETAILED DESCRIPTION OF THE DRAWINGS

Figure 1:
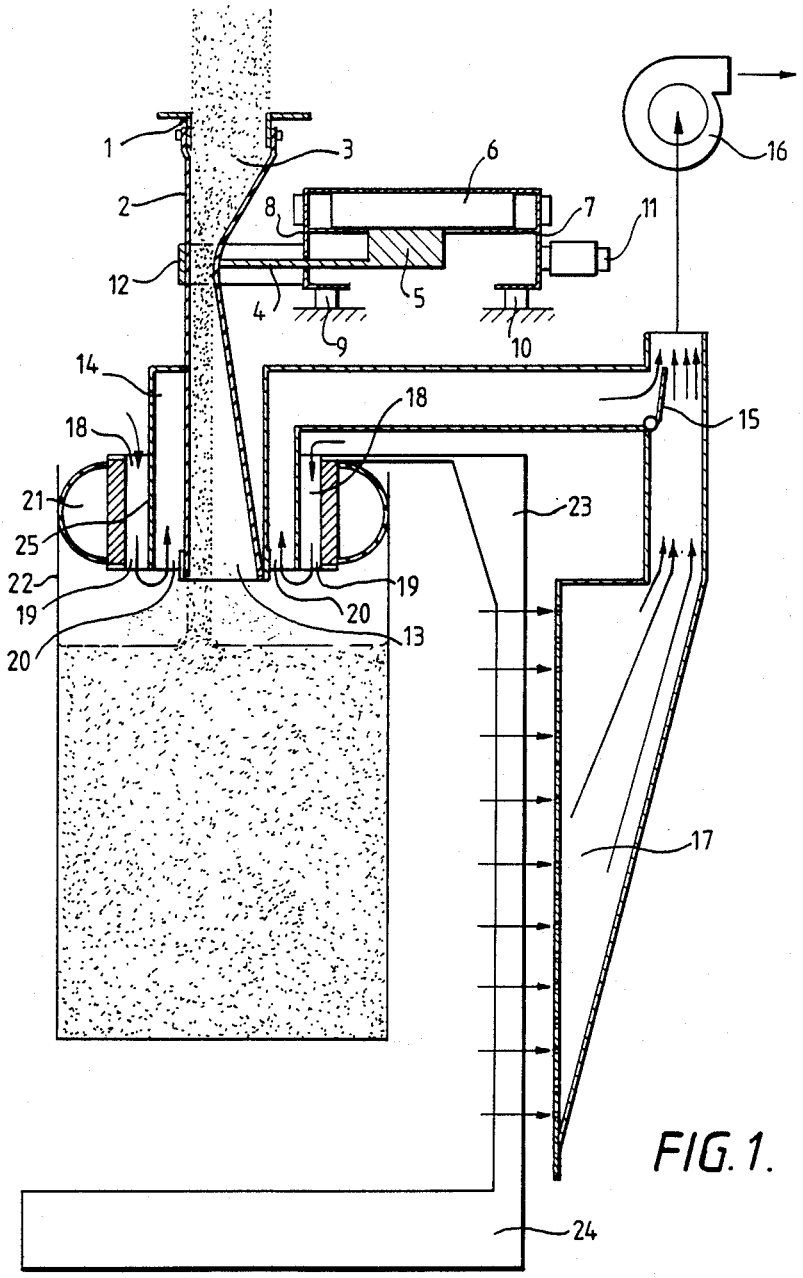

In FIG. 1 a feed inlet (1) feeds powder from a bulk supply (not shown) into a conduit (2) which is made of highly resilient material comprising preferably a high proportion of natural rubber. The passage of powder (3) through conduit (2) is controlled by a constriction caused by a slide closure (4) which is connected to a slide plate (5). The slide plate is connected to a piston head which is made to reciprocate horizontally within air cylinder (6). The cylinder is supported by end brackets (7 and 8) on antivibration mountings (9 and 10). Bracket (8) has attached to it a front end bracket (12). The effect of bracket (12) and slide closure (4) is to produce a valve consisting of a nip within which the resilient conduit (2) can be squeezed and constricted. The valve can also be vibrated by vibrator (11) and the vibrations thus produced are communicated to the powder in the region of the nip and ensure that the powder is maintained in a readily flowable condition.

The discharge end (13) of conduit (2) is surrounded by an exhaust air duct (14) which communicates via an air control valve (15) to an exhaust fan (16) and also to a perforated plenum plate (17). The exhaust air duct (14) includes an outlet (20) for exhausting air from the container (22). Arranged concentrically round the exhaust air duct (14) is a second conduit (18) one end of which communicates with the atmosphere whilst the other end defines an inlet (19) opening into the container. Inlet (19) and outlet (20) are juxtaposed and have a wall portion (25) which is common to both conduits (14 and 18). An inflatable annulus (21) made preferably from natural rubber is secured to the outer wall of conduit (18) and when inflated as shown in the figure it forms an air-tight seal with the inner wall of a container bag (22) which is supported by column (23). The latter extends down to the base (24) of a weighing machine.

The operation of filling containers with the apparatus described above takes place in a number of stages the timing of which is controlled by a sequencing system not shown. During the filling stage valve (15) is adjusted so as to ensure that a very low rate of air flow is maintained through conduit (14). During this operation the rate of exhaustion by fan (16) is not reduced. Consequently the balance of the air being drawn into the system enters through plenum plate (17). The need to maintain a low air flow at this stage stems from the fact that a higher rate is liable to create a partial vacuum in the container and this has an adverse effect on the accuracy of the weighing of the container which takes place during the filling process. When this process had been completed, annulus (21) is deflated preparatory to removal of the bag. Since the weighing has now also been completed valve (15) can now be adjusted so that there is a high rate of air flow through conduit (14), the effect of which is not only to remove any powder which may have been deposited in the conduit but also any powder which is suspended in the space above the layer of powder present in the container. Throughout the operation there is a draught through conduit (18) thus providing a barrier to the escape of powder into the atmosphere. The figure shows the state of the apparatus during one of its stages of operation. In this stage powder (3) is flowing down into container (22) through conduit (2). The flow is controlled by the valving effect produced by the cooperation of slide closure (4) and front end bracket (12) and the vibration of these two members by vibrator (11). Air is displaced from the container by the downwardly moving stream of powder and is drawn away through exhaust conduit (14) together with some entrained powder by fan (16). At the same time air is drawn into the second conduit (18) and directly as it issues from outlet (19, it is sucked into opening (20) of the exhaust air conduit (14) without causing any significant disturbance to the powder in the container. In this way the stream of air within the conduit (14) can be made to be sufficiently vigorous to prevent powder becoming deposited in the conduit whilst at the same time the removal of excessive quantities of powder by the air stream is prevented. A further advantage of this arrangement is that the apparatus can be programmed to more accurately deliver a predetermined weight of powder to the container.

Figure 2:
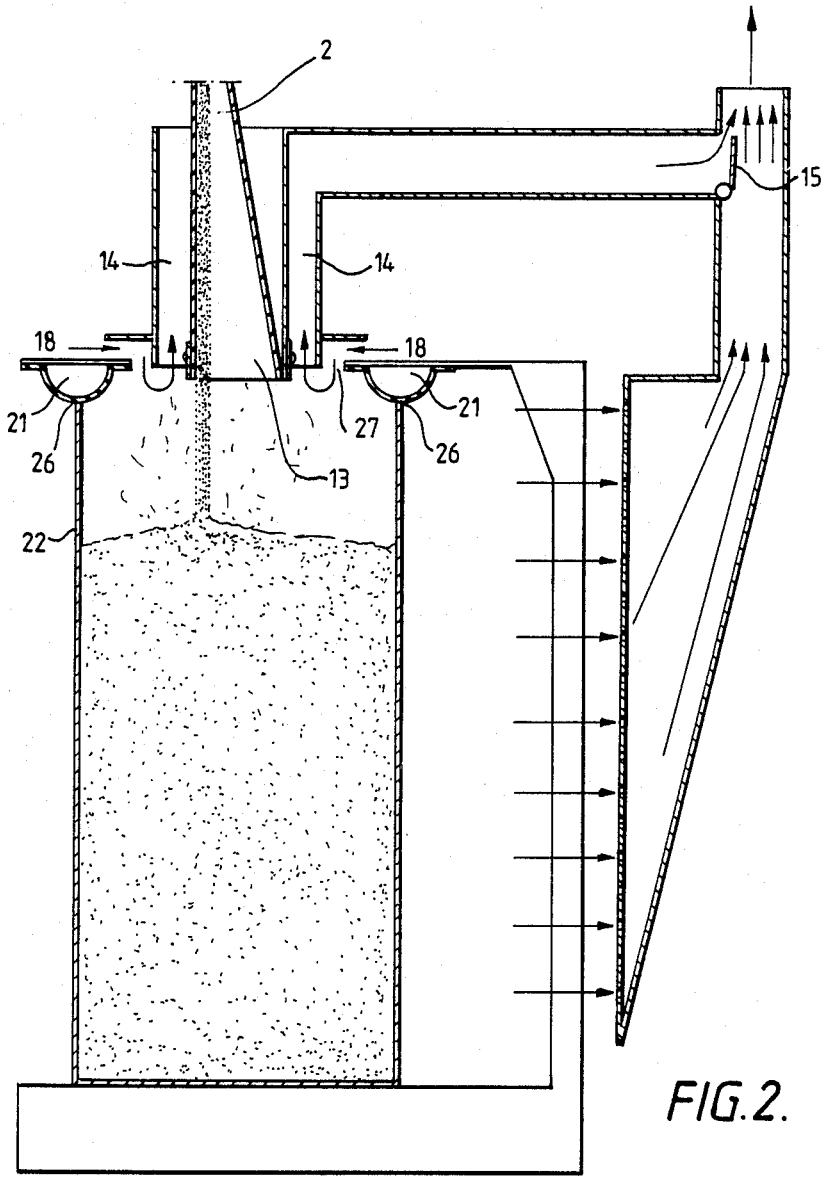

FIG. 2 illustrates the use of the present apparatus for delivery of powder into a drum having substantially rigid walls. A method by which this apparatus is used is similar to that described for the apparatus described in FIG. 1. The discharge end (13) of conduit (2) communicating with a bulk supply of powder (not shown) is positioned above the mouth of drum (22). There is arranged concentrically round conduit (2) an exhaust air duct (14) which as in FIG. 1 communicates with an air control valve (15) and an exhaust fan (not shown). Sealing of the apparatus to the drum (2) is by means of an inflated annulus (21) whichi is made of preferably natural rubber and which presses down axially onto the rim (26) of the wall of drum (22). Conduit (18) enables a stream of air to enter the container when the exhaust pump is in operation and valve (15) is set to allow communication between exhaust air duct (14) and the fan. The entry aperture (27) of conduit (18) and the exit aperture of exhaust air duct (14) are juxtaposed and a part of the walls of both duct (14) and conduit (18) are common to one another. As a consequence when the filling operation is taking place a sufficiently vigorous stream of air can be maintained through the drum over the surface of the powder already delivered without any serious disturbance of the powder. At the same time accumulation of powder in exhaust duct (14) is prevented.

I claim:

1. An apparatus for transferring a powder from a bulk supply to a container normally filled with air, said apparatus comprising: first conduit means for dispensing the powder into the air filled container; sealing means disposed about said first conduit means for perfecting a seal between said first conduit means and the container; and exhaust means for exhausting air and powder from the container displaced by the powder deposited into the container during the dispensing of powder from said first conduit means, said exhaust means including a second conduit having an outlet opening for conducting the air and powder displaced from the container and a third conduit having an ambient air inlet orifice fluidly communicating ambient air to inside said container, said orifice of said third conduit being in close proximity to said opening of said second conduit for providing a vigorous stream of air flow through said orifice to said outlet opening to prevent deposition of powder in said exhaust means without a major disturbance of powder already in the container.

2. An apparatus as set forth in claim 1 including suction means in fluid communication with outlet opening of the second conduit for assisting removal of displaced air and for drawing a stream of air from the outside of said apparatus through said orifice.

3. An apparatus as set forth in claim 2 wherein said exhaust means includes a second conduit including said opening and a third conduit including said orifice.

4. An apparatus according to claim 2 wherein the outlet opening of the second conduit within the container and the ambient air inlet orifice of the third conduit are juxtaposed and the second and third conduits including a common wall which defines a part of each of the conduits.

5. An apparatus according to claim 2 wherein the second and third conduits are disposed concentrically with respect to each other.

6. An apparatus according to claim 1 including an inflatable annulus disposed around the second conduit adapted to enter in air-tight engagement radially with the wall of a container having a flexible wall.

7. An apparatus according to claim 1 including an inflatable annulus disposed around the second conduit adapted to enter into engagement axially with the rim of a wall of a container having a rigid wall.

8. An apparatus according to claim 1 wherein means are provided to control the flow of powder into the container.

9. An apparatus according to claim 8 wherein the control means is a vibrating valve.

* * * * *

UNITED STATES PATENT AND TRADEMARK OFFICE

CERTIFICATE OF CORRECTION

PATENT NO. : 4,825,913

DATED : May 2, 1989

INVENTOR(S) : Leslie Stott et al.

It is certified that error appears in the above-identified patent and that said Letters Patent is hereby corrected as shown below:

Column 1, line 18, delete "is" (second occurrence) and insert therefor --it--.

Column 3, line 68, delete "," and insert therefor --)--.

Column 4, line 22, delete "whichi" and insert therefor --which--.

Signed and Sealed this

Second Day of October, 1990

*Attest:*

HARRY F. MANBECK, JR.

*Attesting Officer*

*Commissioner of Patents and Trademarks*